United States Patent [19]

Piper

[11] 4,442,314

[45] Apr. 10, 1984

[54] SHIELDED WOVEN CABLE ASSEMBLY AND METHOD OF MAKING SAME

[75] Inventor: Douglas E. Piper, Greenville, S.C.

[73] Assignee: Woven Electronics Corporation, Mauldin, S.C.

[21] Appl. No.: 409,127

[22] Filed: Aug. 18, 1982

[51] Int. Cl.[3] ..... H01B 7/08; H01B 11/06

[52] U.S. Cl. ..... 174/36; 139/425 R; 156/55; 156/148; 174/115; 174/117 M

[58] Field of Search ..... 174/36, 115, 117 M; 139/425 R; 156/148, 52, 53, 54, 55

[56] References Cited

U.S. PATENT DOCUMENTS

| | | | |
|---|---|---|---|
| 975,358 | 11/1910 | Hefter | 139/425 R |
| 3,476,870 | 11/1969 | Ross | 174/117 M |
| 3,582,537 | 6/1971 | Perreault | 174/117 M |
| 3,612,743 | 10/1971 | Angele | 174/36 |
| 4,095,042 | 6/1978 | Ross | 174/36 |
| 4,158,104 | 6/1979 | Ross | 156/55 X |
| 4,281,211 | 7/1981 | Tatum et al. | 174/36 |

FOREIGN PATENT DOCUMENTS

| | | | |
|---|---|---|---|
| 17077 | 10/1980 | European Pat. Off. | 174/36 |

*Primary Examiner*—J. V. Truhe
*Assistant Examiner*—Morris H. Nimmo
*Attorney, Agent, or Firm*—Dority & Flint

[57] ABSTRACT

A woven shielded cable assembly includes a woven cable (A) having a base weave pattern defined by warp and weft elements (14) and (16). A plurality of drain wires (B) are interwoven with and floated out of the base weave pattern at locations along the cable on both sides thereof to provide instantaneous and continuous draining of a conductive shield (C).

8 Claims, 6 Drawing Figures

SHIELDED WOVEN CABLE ASSEMBLY AND METHOD OF MAKING SAME

BACKGROUND OF THE INVENTION

The invention relates to woven high frequency transmission cables and more particularly to the shielding of such cables from external high frequency electrical noises such as RF noises which affect the signals being transmitted by the cable. Shielded cable assemblies are also utilized to reduce the noise emitted from the cable itself in order to interfere with surrounding circuitry or electrical devices such as to reduce the hazard of electrical noises interfering with pacemaker devices implanted in heart patients.

In the past, aluminum foil and other similar metals have been used to provide a jacket or sheath which surrounds the transmission in order to reduce the incoming and outgoing noises.

Various arrangements have been provided for draining the high frequency electrical noises from the shield such as soldering a pigtail to the uninsulated side of the jacket. Other means provided have been the laying of an uninsulated conductor wire along the length of the cable sandwiched between the jacket and the cable to drain the noises from the shield. However, the single drain wire does not contact both sides of the shield jacket. This results in increasing the shield's complex impedance which effectively repulses the ability of the shield to adequately drain high frequency noise. In the pigtail connection, considerable amount of time is involved in the process of making the soldered pigtail connection. The connection is also highly susceptible to becoming loose whereby the shield is not drained effectively.

Of the aforementioned types, U.S. Pat. Nos. 4,281,211 and 3,582,532 disclose a metal foil sheath which is drained by a pigtail connector. U.S. Pat. Nos. 4,268,714 and 3,794,750 disclose drain wires in continuous contact with a metal shield.

Accordingly, an important object of the present invention is to provide a shielded woven cable assembly having improved drainage for the shield.

Still another important object of the present invention is to provide a shielded woven cable having drain wires which are terminated in a simple and convenient manner and which provides an effective shield for all applications.

Still another important object of the present invention is to provide a means for draining a shielded woven cable in which the drain is constructed with the woven cable and does not require a separate drain wire or other means for draining the shield.

Still another important object of the present invention is to provide a method for terminating and draining a shield for a woven cable assembly wherein the drain for the shield is woven as integral cable structure with the woven cable.

Another important object of the present invention is to provide a means for selectively isolating certain portions of a cable from noise generated in other sections of the cable by selectively arranging drain wires in the cable which make electrical connection with a shielded jacket surrounding the cable.

SUMMARY OF THE INVENTION

The above objectives are accomplished according to the invention by weaving in a base weave pattern of a woven cable a plurality of drain wires which are floated in and out of the base weave pattern to expose a portion of the drain wire on both sides of the woven cable. When the cable is enclosed in a metal shield, the drain wire contacts both sides of the metal shield on opposing sides of the cable to effectively drain the shield along the entire length and width of the cable. The drain wires may be terminated at the end of the cable by connecting them to proper ground terminals at the end of the cable. In a preferred embodiment, the drain wires are woven in the warp direction of the cable and are woven either in alignment across the width of the cable in the weft direction or may be staggered across the width of the cable.

BRIEF DESCRIPTION OF THE DRAWINGS

The construction designed to carry out the invention will be hereinafter described, together with other features thereof.

The invention will be more readily understood from a reading of the following specification by reference to the accompanying drawings forming a part thereof, wherein an example of the invention is shown and wherein.

DESCRIPTION OF A PREFERRED EMBODIMENT

Figure 1:
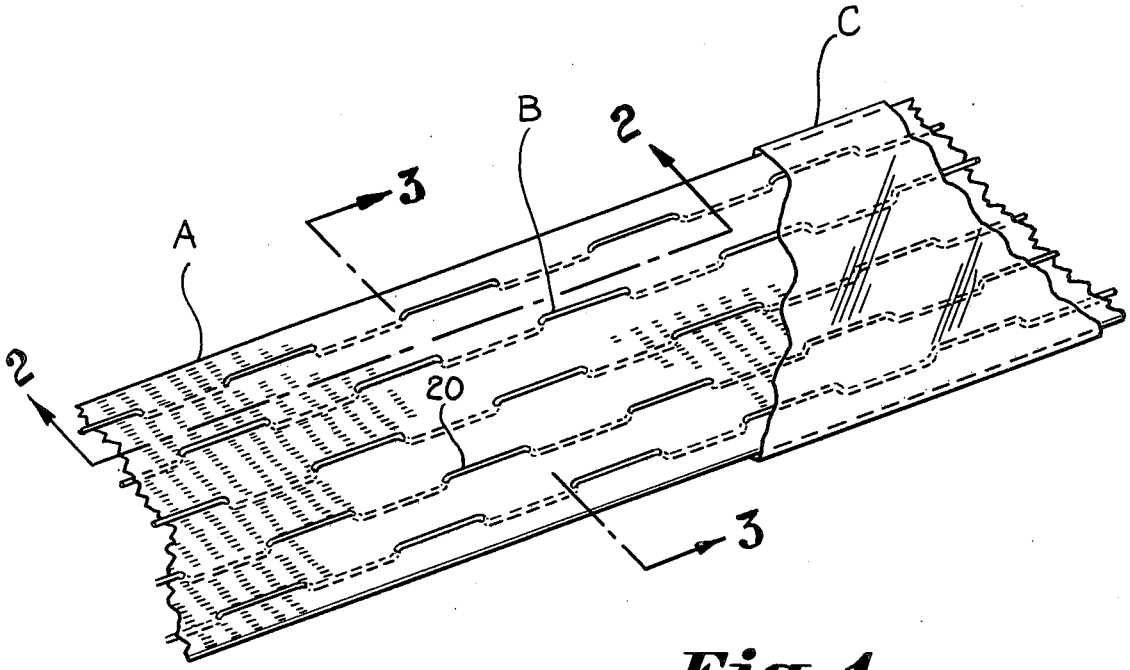
FIG. 1 is a perspective view illustrating a shielded woven cable assembly constructed according to the present invention.

The invention relates to a shielded woven cable assembly and method for effectively draining a metallic shield which jackets the woven cable assembly. While the invention has been illustrated in combination with a flat woven cable of a general plain weave pattern, it is to be understood that the principle of the invention may be applied to cables of many configurations and constructions.

Referring now in more detail to the drawings, a woven cable A is illustrated which includes a plurality of warp elements which includes warp conductors 10 which are electrical conductors such as insulated 28 AWG wire. Further warp elements include a plurality of warp binder yarns 14, such as Nomex nylon, interwoven with a weft filling or element 16 to form a base weave pattern with the warp conductor elements 10.

It is to be understood that other base weave patterns may also be utilized with the present invention such as a twill weave pattern disclosed in U.S. Pat. No. 3,909,508 wherein the warp binders 14 are omitted and the filling strand is interwoven only with the conductor wires 10 as warp elements.

According to the present invention, a plurality of metallic drain wires B which consist of uninsulated metal wires such as aluminum are interwoven with the base weave pattern in such a manner that a portion 18 of the drain wire is floated out of the weave pattern on one side of the cable. Another portion 20 of the drain wire is floated out on the opposite side of the base weave pattern. In the illustrated embodiment, the drain wire is interwoven with the filling element 16 for example at 16*a* and 16*b*, and is floated out for four picks of the filling element on each side of the cable A.

Figure 3:
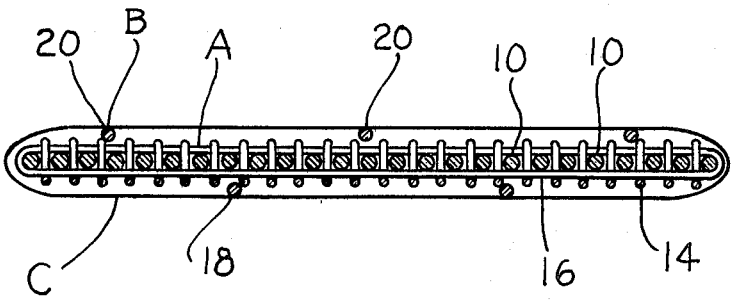
FIG. 3 is a sectional view taken along line 3—3 of FIG. 1.

A metallic shield jacket C constructed from a conductive material such as aluminum foil is wrapped around and jackets the woven cable A. As can best be seen in FIGS. 3 and 4 the metallic shield contacts the floated portions 18 and 20 of the drain wires B along generally the entire length and width of the woven cable and shield. The floated portions of the drain wire provide good and effective draining of the shield jacket continuously on both sides of the shield across its width and length. Thus, electrical noise signals existing at any point in the foil shield are instantaneously drained.

The drain wires are staggered in the weft direction of the woven cable along the length of the cable as can best be seen in FIG. 1 so as to provide good spacing of the contact location of the floated portions with the shield C.

Figure 2:
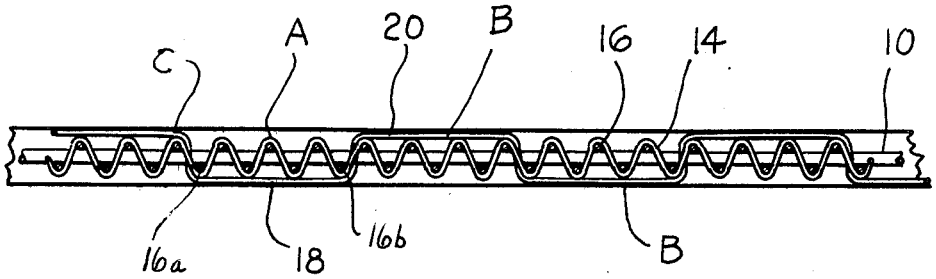
FIG. 2 is a sectional view taken along line 2—2 of FIG. 3.
Figure 4:
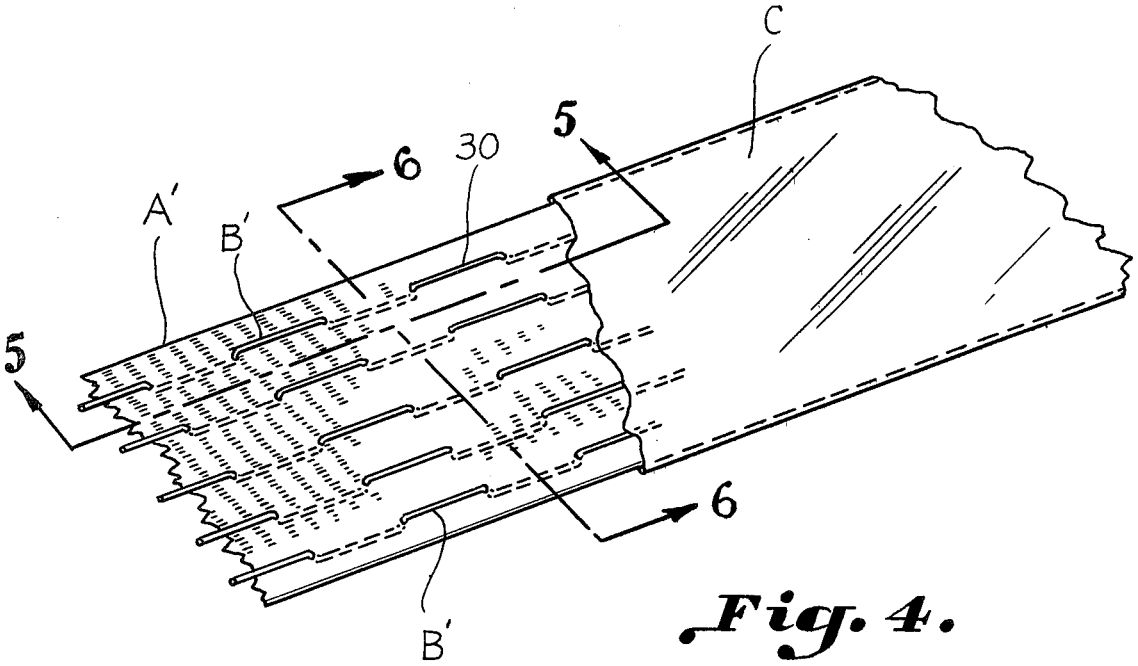
FIG. 4 is an alternate embodiment of a shielded cable assembly constructed according to the present invention wherein drain wires for draining the shield are woven into the cable in lateral alignment.
Figure 5:
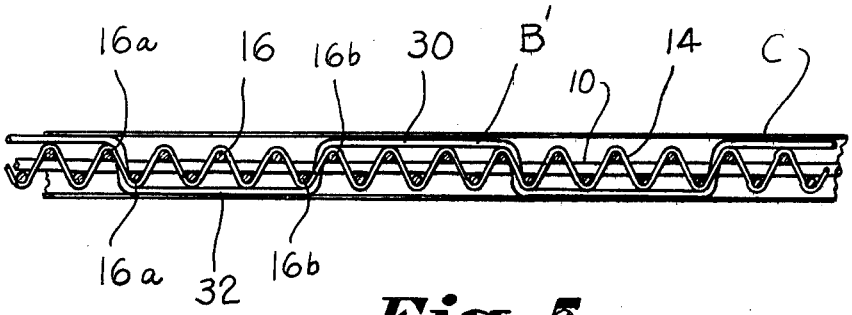
FIG. 5 is a sectional view taken along line 5—5 of FIG. 4.
Figure 6:
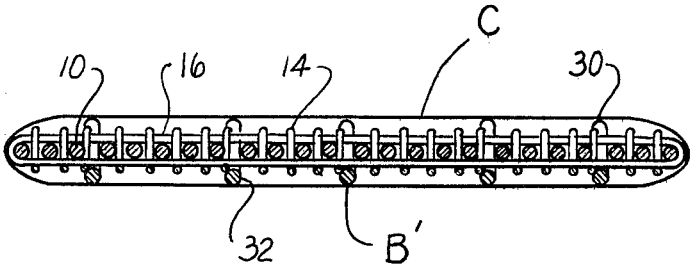
FIG. 6 is a sectional view taken along line 6—6 of FIG. 4.

As illustrated in FIG. 4, drain wires B′ are woven in alignment in the weft direction across the width of woven cable A′ along its length. Floated portions 30 and 32 are formed on opposing sides of the woven cable. The base weave pattern of the woven cable itself may be the same as that shown in FIGS. 1–3 and as described previously. The staggered relationship of the floated drain wires as illustrated in FIG. 1 occurs by breaking the floated portions of the drain wires out at different picks of the filling element staggered along its length as is well within the skill of one in the weaving art. In the cable A′ of FIGS. 4–6, the adjacent drain wires B′ are interwoven with the same pick at each break through point along the cable. Other staggered patterns for the drain wires may also be utilized such as random staggering in order to assure contact with shield C at desired locations.

Thus, it can be seen that a highly advantageous construction and method can be had for a shielded cable assembly according to the invention wherein instantaneous draining of the shield is provided for effective shielding of internal and external noises. The shield is contacted on both sides in the case of a flat assembly so that spurious signals are drained immediately rather than having to pass around the shield or through the cable to the other side.

While in the illustrated embodiments, five parallel drain wires have been illustrated, it is to be understood that any number of drain wires may be utilized in the cable construction as required to meet the particular application being made.

While a preferred embodiment of the invention has been described using specific terms, such description is for illustrative purposes only, and it is to be understood that changes and variations may be made without departing from the spirit or scope of the following claims.

What is claimed is:

1. A continuously shielded woven electrical transmission cable assembly comprising:

a plurality of elongated warp elements extending in the warp direction in said woven cable;

a filling element interwoven with said warp elements to define a base weave pattern;

at least a number of said elongated warp elements being electrical signals conductor elements arranged in said weave pattern for transmitting electrical signals through said cable;

a plurality of uninsulated drain wires woven in the base weave pattern of said woven cable from one side of said woven cable to another side of said woven cable;

said drain wires being floated out of said base weave pattern at spaced picks of said filling element along the length of said cable;

a conductive shield jacketing said woven cable, said drain wires on each side of said woven cable contacting said shield on corresponding sides of said shield; and said drain wires being woven in said base weave generally along the entire length of said woven cable for continuous immediate draining of said shield and termination of said drain wires at the ends of said cable.

2. The assembly of claim 1 wherein said woven cable is generally flat and said drain wires are woven over and under said filling element on both sides of said flat cable.

3. The woven assembly of claim 1 wherein adjacent ones of said drain wires are floated out of said base weave pattern at staggered picks along the length of said cable.

4. The assembly of claim 1 wherein all said warp elements are conductor wires.

5. The assembly of claim 1 wherein a number of said warp elements are warp binder yarns woven with said filling elements.

6. A method of constructing a continuously shielded woven electrical transmission cable comprising the steps of:

weaving a plurality of warp elements with a filling element to define a base weave pattern;

including in said plurality of warp elements at least a number of electrical signal conductor elements;

weaving a plurality of drain wires in said cable generally from one side of the cable to the other side of said cable;

floating said drain wires out of said base weave patterns at spaced locations of said cable along the length thereof;

enclosing said woven cable in a metallic shield;

contacting said shield on both sides of said woven cable and said shield with floated said drain wires to effectively and instantaneously drain said shield on both sides of said shield along the length of said cable.

7. The method of claim 6 including floating said drain wires out of said base weave pattern at staggered picks of said filling element along the length of said cable.

8. The method of claim 6 including weaving all of said plurality of warp elements as electrical conductor elements extending in the warp direction.

* * * * *